United States Patent [19]

Woertche

[11] 4,297,826

[45] Nov. 3, 1981

[54] APPARATUS FOR PACKAGING TAPE CASSETTES

[76] Inventor: Helmuth Woertche, 70 Don Park Rd. Unit 7, Markham, Ontario, Canada, L3R 1G4

[21] Appl. No.: 69,081

[22] Filed: Aug. 23, 1979

[51] Int. Cl.[3] ..... B65B 5/04; B65B 25/00

[52] U.S. Cl. ..... 53/157; 53/174; 53/266 R; 53/382

[58] Field of Search ..... 53/157, 238, 174, 566, 53/252, 266 R, 382

[56] References Cited

U.S. PATENT DOCUMENTS

| | | | |
|---|---|---|---|
| 1,308,321 | 7/1919 | Armstrong | 53/157 |
| 1,853,447 | 4/1932 | Mouns | 53/174 X |
| 1,938,982 | 12/1933 | Chalmers | 53/174 X |
| 2,263,501 | 11/1941 | Jones | 53/157 X |
| 2,962,849 | 12/1960 | Layton, Jr. | 53/382 X |
| 3,896,606 | 7/1975 | Utsumi | 53/238 X |
| 4,201,027 | 5/1980 | Ilsemann | 53/238 |

*Primary Examiner*—John Sipos
*Attorney, Agent, or Firm*—Jerome P. Bloom

[57] ABSTRACT

The invention relates to an apparatus for packaging tape cassettes, one at a time, from a conveyor. The apparatus includes a loading device for moving the cassettes along a straight line path of travel from one end of said apparatus to the other end thereof, a vacuum suction head for removing inserts (one at a time) from a magazine and moving the inserts into the path of travel of the cassettes in a partially folded condition so that each cassette enters an insert. The apparatus also includes a further suction head for removing boxes (one at a time) from a second magazine and for positioning the boxes in the path of travel of the cassettes and inserts, arms for retaining the boxes in the open position for receiving the cassettes and inserts, and a closing device biased towards the path of travel for closing each box with a cassette and insert therein.

4 Claims, 1 Drawing Figure

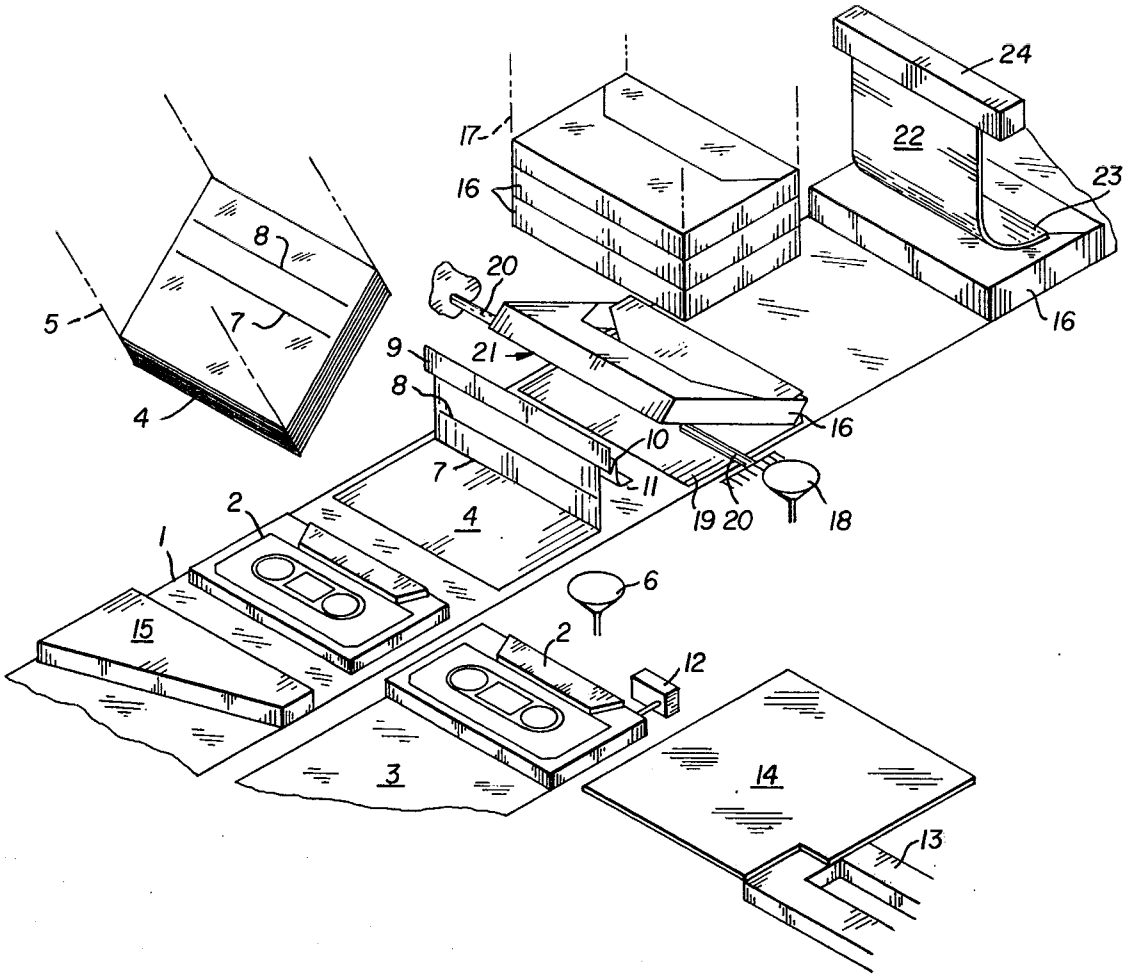
23
24
16
22
16
18
20
19
10
11
6
12
13
14
17
16
20
21
9
8
7
4
2
3
8
7
4
5
2
1
15

APPARATUS FOR PACKAGING TAPE CASSETTES

This invention relates to an apparatus for packaging tape cassettes.

At present, tape cassettes are packaged using multi-stationed systems, i.e., separate machines are used for a thin cardboard half-sleeve placing the cassette in (commonly referred to as an insert), and then for loading the insert and cassette into a box. There exists a need for an apparatus which performs all of the packaging operations at a single station. Obviously, such an apparatus should not merely be an aggregation of existing machines, but should be reasonably compact and uncomplicated.

A search of the prior art in this area provides little guidance U.S. Pat. Nos. 980,917 issued to E. L. Bracy on Jan. 10, 1911; 1,722,229, issued to W. E. Moling on July 23, 1929; 3,293,825, issued to A. Schmermund on Dec. 27, 1966 and 3,455,086, issued to F. Bescript et al on July 15, 1969 disclose elements of apparatuses which can be used to package articles such as cassettes. However, none of the patents discloses a machine or apparatus capable of carrying out a complete packaging procedure of the type proposed by the present invention.

The object of the present invention is to provide a relatively simple cassette packaging apparatus, which places the cassette an insert, and loads the insert and cassette into a box at a single work station.

Accordingly the present invention relates to a cassette packaging apparatus comprising first conveyor means for moving cassettes one at a time along a straight line path of travel; first feed means for feeding inserts one at a time into the path of travel of the cassettes downstream of each cassette in the direction of travel of the cassette along said straight line path of travel; folding means for placing each cassette in an insert during travel of the cassette along said path of travel; second feed means for feeding boxes one at a time in an open position into said path of travel of downstream of each cassette and insert in the direction of travel of the cassette along said straight-line path of travel, whereby each cassette and insert combination travelling along said straight line path of travel enters a box; and means for closing said box with a cassette and insert therein.

More specifically, the first conveyor means is a rectilinear track for receiving the cassettes one at a time from a conveyor belt, which carries the cassettes to a position adjacent to the leading end of the path of travel. A pusher moves the cassettes one at a time onto the track and operation of the first and second feed means is initiated. After a suitable delay, i.e. after an insert and box have been positioned in the path of travel of a cassette downstream thereof in the direction of travel of the cassette, a loading device pushes the cassette along the path of travel into an insert, and then pushes the cassette and insert into a box. The box is closed by a closing device which is a spring plate biased toward the path of travel of the cassette, insert and box.

The apparatus of the present invention is relatively small, utilizing few moving parts, electronic components and pneumatic elements. Maintenance is somewhat reduced, and the cost of the apparatus can be kept low.

The invention will now be described in greater detail with reference to the accompanying drawing, the single FIGURE of which is a perspective, schematic view of a preferred embodiment of the invention.

With reference to the drawing, the cassette packaging apparatus of the present invention includes a conveyor defined by a loading track 1 along which cassettes 2 are moved one at a time along a straight line path of travel. The cassettes 2 are carried to the apparatus by an ordinary conveyor belt 3, which is parallel to the track 1, terminating at the leading end of the track 1.

In operation, an insert 4 is removed from a magazine 5 located above the track 1. The inserts 4 are removed one at a time from the magazine 5 by a lever operated vacuum cup 6 normally located beneath the track 1. Each insert 4 is provided with pre-formed fold lines 7 and 8, which are pre-creased sufficiently to permit proper alignment of the insert 4 with the track 1 and the cassette 2.

A first 90° fold is effected by pulling the insert 4 downwardly beneath the track 1 by means of vacuum cup 6, so that the rear portion of the insert strikes a folding device 9. The device 9 is provided with an inverted V-shaped groove 10 and an arcuate folding flange 11. After moving downwardly to beneath the track 1, the insert 4 is raised to the level of the track 1, the upper edge of the insert being held in position by the walls of the inverted V-shaped groove 10 of the folding device 9.

As soon as the insert 4 is in the loading position, and upon striking a limit switch 12, a cassette 2 is transferred to the track 1 from the conveyor belt 3 by a pusher 13. The pusher 13 includes a hold down plate 14 for holding the cassette down over a pre-folded insert 4 during loading. The pusher 13 moves the cassette 2 perpendicular to the conveyor belt 3 and the track 1 to a position in front of a loading device 15. In the forwardmost position of the pusher 13 the plate 14 overlaps the pre-folded insert 4. The loading device 15 and the track 1 defines a conveyor for moving the cassettes 2 along the length of the apparatus.

As a cassette 2 is being transferred to the track 1, a box 16 is removed from a magazine 17 by means of a lever controlled vacuum cup 18 which is also normally positioned beneath the track 1. The cup 18 is raised to engage cover 19 of a box 16. Two arms 20 mounted on the bottom end of the magazine 17 engage main body 21 of the box 16 while the cover 19 is pulled to the open position shown in the drawing by the vacuum cup 18.

When a cassette 2, insert 4 and box 16 are all in the loading position described above, the loading device 15 is actuated to move the cassette 2 along the track 1 onto the partially folded insert 4. The insert 4 at this time is folded along fold line 7 as illustrated in the drawing. The loading device 15 pushes both the cassette 2 and the insert 4 beneath the folding and retaining device 9, which folds the insert 4 along fold line 8. Thus, the insert 4 is folded around one side of the cassette 2. Continued movement of the cassette 2 and insert 4 along the track 1, i.e., pushing by the loading device 15 deposits the cassette 2 and the insert 4 in the open box 16. All three elements are then pushed from beneath the magazine 17 to a closing device defined by a thin brass spring plate 22 with a bottom end 23 curved away from the direction of travel of the cassette 2, insert 4 and box 16. The plate 22 extends downwardly from a horizontal arm 24 into the path of travel of the components for resiliently pressing against the base of the main body 21 of the box 16 to close the latter.

A conveyor (not shown) removes the loaded and closed box 16, and the loading device 15 returns outside of the track 1 to the leading end of the latter. The entire cycle is repeated with the arrival of the loading device 15 at the leading end of the track 1, provided that a new insert 4, cassette 2 and box 16 have been positioned properly.

While the foregoing description may appear somewhat general, it is worth noting that the invention resides not in the individual elements which are known, but in the combination of elements. In practice, the various feed elements are operated mechanically, and clutches, which move elements such as the levers (not shown) controlling the vacuum cups 6 and 18, are actuated by solenoids or the like, which in turn are triggered by the limit switch 12 and other position sensing switches. Many of the specific elements can be replaced by mechanical equivalents. For example, the limit switch 12 could be replaced by a mechanical or electronic sensor.

I claim:

1. A cassette packaging apparatus for packing said cassettes in boxes having a body and a cover pivotally connected thereto comprising first conveyor means for moving cassettes one at a time along a straight line path of travel; first feed means for feeding inserts one at a time into the path of travel of the cassettes downstream of each cassette in the direction of travel of the cassette along said straight line path of travel; means for folding an insert about at least a portion of each cassette during travel of the cassette along said path of travel; second feed means for feeding boxes one at a time in an open position into said path of travel downstream of said folding means in the direction of travel of the cassette along said straight line path of travel, said second feed means including means for retaining the body of each said box above said path of travel with the cover thereof in an open position in said path of travel, whereby each cassette and insert combination travelling along said straight line path of travel enters a box; and means for closing each said box with a cassette and insert therein, said closing means including a spring plate extending downwardly into said path of travel, whereby the body of a box passing beneath said plate is pushed against the cover to the closed position.

2. An apparatus according to claim 1, wherein said first conveyor means includes a rectilinear track defining said straight line path of travel for said cassettes and a loading device for pushing said cassettes one at a time along said track successively to said folding means, second feed means and closing means.

3. An apparatus according to claim 1, wherein said folding means includes means for partially folding each said insert, and means for retaining a partially folded insert in said straight line path of travel for receiving a cassette.

4. An apparatus according to claim 1, including second conveyor means for carrying cassettes to the leading end of said path of travel, and pusher means for moving said cassettes one at a time from said second conveyor means into said path of travel.

* * * * *